US009301053B2

(12) United States Patent
Guo et al.

(10) Patent No.: US 9,301,053 B2
(45) Date of Patent: Mar. 29, 2016

(54) AUDIO TRANSDUCER WITH ELECTROSTATIC DISCHARGE PROTECTION

(71) Applicant: Nokia Corporation, Espoo (FI)

(72) Inventors: Jian Guo, San Diego, CA (US); Antero Tossavainen, Espoo (FI); Veijo Kajanus, Sunnyvale, CA (US); Jingyu Huang, San Diego, CA (US)

(73) Assignee: Nokia Corporation, Espoo (FI)

( * ) Notice: Subject to any disclaimer, the term of this patent is extended or adjusted under 35 U.S.C. 154(b) by 104 days.

(21) Appl. No.: 14/087,078

(22) Filed: Nov. 22, 2013

(65) Prior Publication Data

US 2015/0146914 A1 May 28, 2015

(51) Int. Cl.

| | |
|---|---|
| ***H04R 9/06*** | (2006.01) |
| ***H04R 1/02*** | (2006.01) |
| ***H04R 9/04*** | (2006.01) |
| ***H04R 9/02*** | (2006.01) |
| ***H04R 19/01*** | (2006.01) |
| ***H04R 31/00*** | (2006.01) |

(52) U.S. Cl.

CPC .. *H04R 9/04* (2013.01); *H04R 9/02* (2013.01); *H04R 19/016* (2013.01); *H04R 31/003* (2013.01); *H04R 2225/49* (2013.01); *H04R 2307/027* (2013.01); *Y10T 29/49005* (2015.01)

(58) Field of Classification Search

CPC ..... H04R 19/00; H04R 2225/49; H04R 2307/027; H04R 2400/11; H04R 2499/11

See application file for complete search history.

(56) References Cited

U.S. PATENT DOCUMENTS

| | | | | |
|---|---|---|---|---|
| 2,857,461 | A * | 10/1958 | Brodie | 381/96 |
| 3,061,675 | A | 10/1962 | MacDonald | |
| 5,406,038 | A | 4/1995 | Reiff et al. | 181/167 |
| 5,878,149 | A | 3/1999 | Hamada | |
| 2004/0233597 | A1 | 11/2004 | Chen et al. | 361/56 |
| 2005/0207610 | A1 | 9/2005 | Kajiwara | |
| 2006/0250731 | A1 | 11/2006 | Parkhurst et al. | 361/56 |
| 2008/0278873 | A1 | 11/2008 | Leduc et al. | 361/56 |
| 2009/0041290 | A1 | 2/2009 | Yang | 381/396 |
| 2010/0061055 | A1 * | 3/2010 | Dabov et al. | 361/679.56 |
| 2010/0321854 | A1 | 12/2010 | Lin et al. | 361/220 |
| 2011/0012747 | A1 | 1/2011 | Hsieh | 340/815.45 |
| 2014/0064510 | A1 | 3/2014 | Grinnip, III | 381/74 |

FOREIGN PATENT DOCUMENTS

| | | | |
|---|---|---|---|
| DE | 3218323 | A1 | 11/1983 |
| EP | 2 876 896 | A1 | 5/2015 |
| TW | 1269599 | B | 12/2006 |

OTHER PUBLICATIONS

"AM229 Series Speaker/Microphone Entrance Panel", Alpha Communications Product Specification Sheet APS163, Jul. 2013, 1 pg.

* cited by examiner

*Primary Examiner* — Matthew Eason
(74) *Attorney, Agent, or Firm* — Harrington & Smith

(57) ABSTRACT

An apparatus including a diaphragm, where the diaphragm includes a membrane having electrically conductive material; a drive configured to move the diaphragm; and a connector configured to connect the membrane to a ground.

23 Claims, 4 Drawing Sheets

AUDIO TRANSDUCER WITH ELECTROSTATIC DISCHARGE PROTECTION

BACKGROUND

1. Technical Field

The exemplary and non-limiting embodiments relate generally to a sound transducer and, more particularly, to electrostatic protection.

2. Brief Description of Prior Developments

Speakers are known which have a metal membrane as a diaphragm.

SUMMARY

The following summary is merely intended to be exemplary. The summary is not intended to limit the scope of the claims.

In accordance with one aspect, an example embodiment is provided in an apparatus including a diaphragm comprising a membrane, where the membrane comprises electrically conductive material; a drive configured to move the diaphragm; and a connector configured to connect the membrane to a ground.

In accordance with another aspect, an example method comprises providing a speaker diaphragm, where the speaker diaphragm comprises a membrane, where the membrane comprises electrically conductive material, where the membrane comprises a connector configured to connect the membrane to a ground; and connecting the diaphragm to a drive, where the drive is configured to move the diaphragm.

In accordance with another aspect, an example method comprises providing a speaker comprising a diaphragm which includes a membrane, where the membrane comprises electrically conductive material, where the membrane comprises an electrical connection section; and connecting the speaker to a printed wiring board, where, when the speaker is connected to the printed wiring board, the membrane is electrically connected through the electrical connection section to the printed wiring board.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
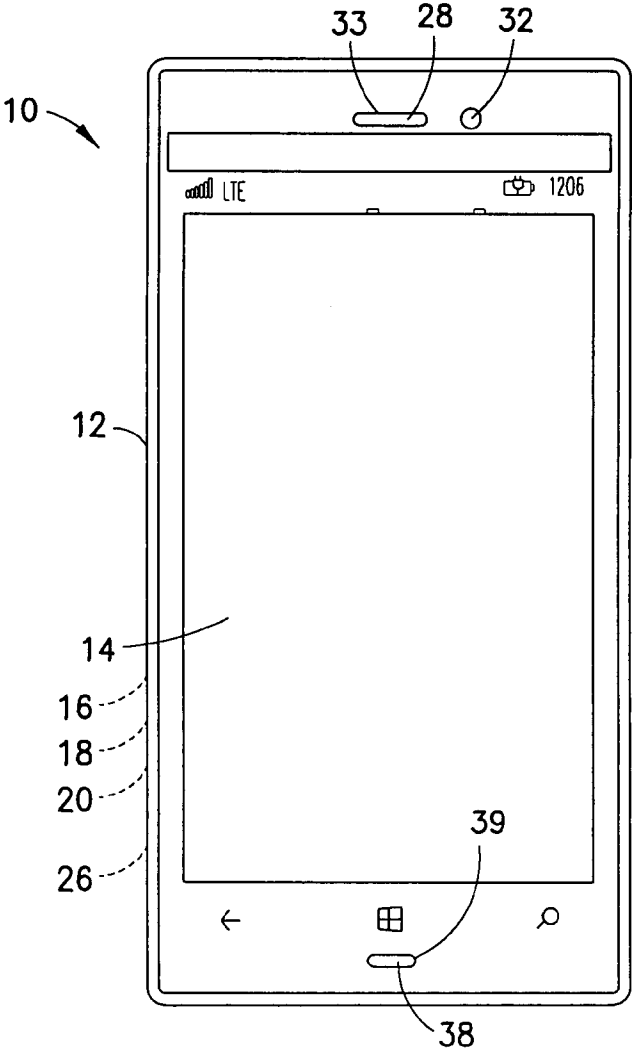
FIG. 1 is a front view of an example embodiment of an apparatus comprising features as described herein.

Referring to FIG. 1, there is shown a front view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The apparatus 10 may be a hand-held portable apparatus, such as a communications device which includes a telephone application for example. In the example shown the apparatus 10 is a smartphone which includes a camera and a camera application. The apparatus 10 may additionally or alternatively comprise an Internet browser application, a video recorder application, a music player and recorder application, an email application, a navigation application, a gaming application, and/or any other suitable electronic device application. In an alternate example embodiment the apparatus might not be a smartphone. For example, the apparatus might be a video recorder or a hand-held gaming device for example.

Figure 2:
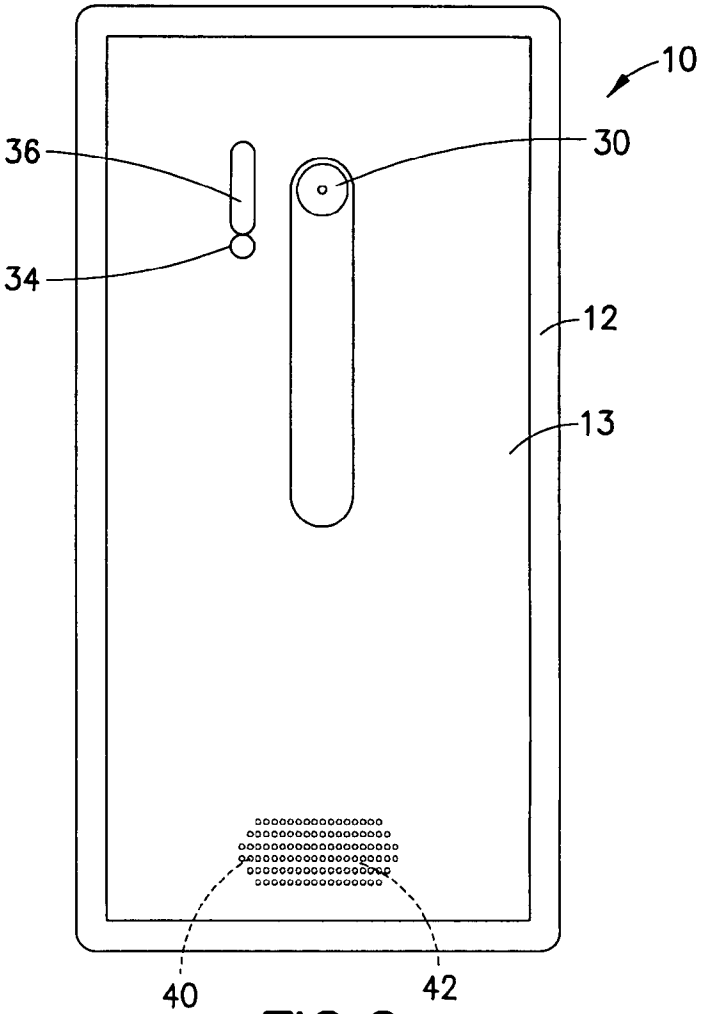
FIG. 2 is a rear view of the apparatus shown in FIG. 1.
Figure 3:
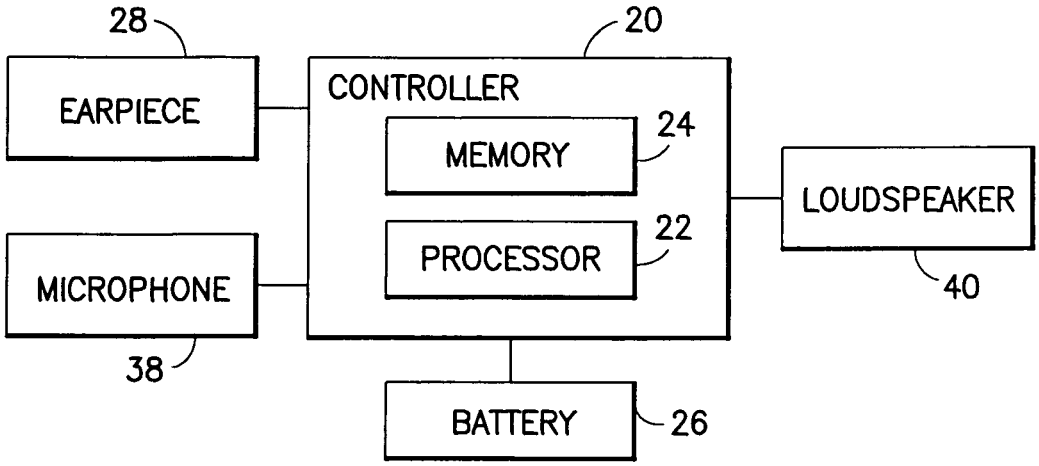
FIG. 3 is a diagram illustrating some of the components of the apparatus shown in FIGS. 1-2.

Referring also to FIGS. 2-3, the apparatus 10, in this example embodiment, comprises a housing 12, a touchscreen 14, a receiver 16, a transmitter 18, a controller 20, a rechargeable battery 26 and a camera 30. However, all of these features are not necessary to implement the features described below. The receiver and the transmitter may be provided in the form of a transceiver for example. The controller 20 may include at least one processor 22, at least one memory 24, and software. The electronic circuitry inside the housing 12 may comprise at least one printed wiring board (PWB) having components such as the controller 20 thereon. The receiver 16 and transmitter 18 form a primary communications system to allow the apparatus 10 to communicate with a wireless telephone system, such as a mobile telephone base station for example.

In this example, the apparatus 10 includes the camera 30 which is located at the rear side 13 of the apparatus, a front camera 32, an LED 34, and a flash system 36. The LED 34 and the flash system 36 are also visible at the rear side of the apparatus, and are provided for the camera 30. The cameras 30, 32, the LED 34 and the flash system 36 are connected to the controller 20 such that the controller 20 may control their operation. In an alternate example embodiment the rear side may comprise more than one camera, and/or the front side could comprise more than one camera. The apparatus 10 includes a sound transducer provided as an air microphone 38. In an alternate example the apparatus may comprise more than one air microphone.

Figure 4:
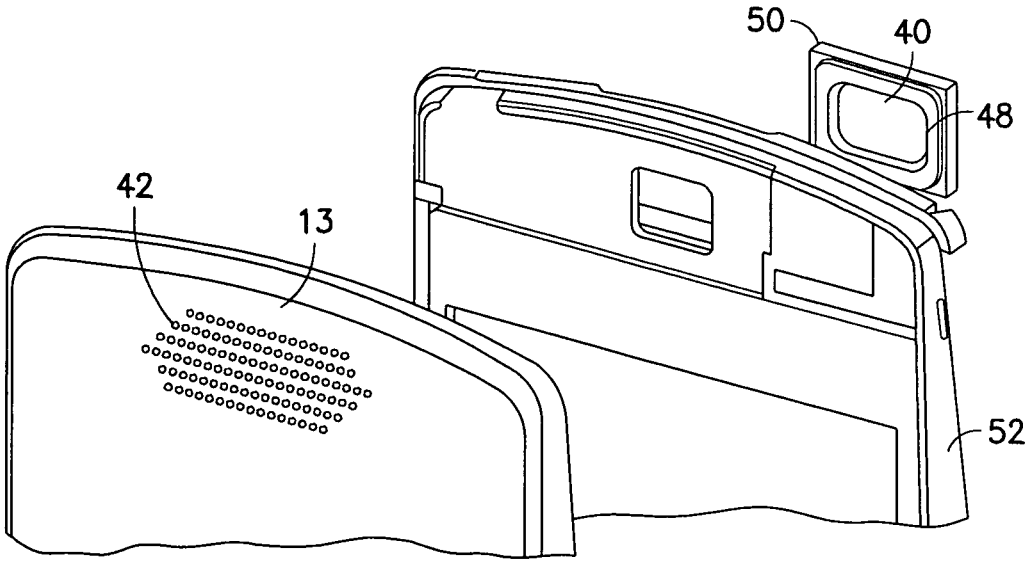
FIG. 4 is a partial exploded perspective view of some of the components of the apparatus shown in FIG. 1.

The apparatus 10 also includes a speaker or earpiece 28 which comprises a sound transducer. Referring also to FIG. 4, the apparatus 10 includes a speaker 40. The housing 12 comprises at least one sound hole 33 for sound to travel from the earpiece 28, at least one sound hole 39 for sound to travel to the microphone, and sound holes 42 for sound to travel from the speaker 40. The description which follows will be in regard to the area at the speaker 40. However, the features described are equally applicable to other coil/magnet assemblies. Features of the invention could be used at the earpiece 28 for example. In the example shown the diaphragm 48 of the speaker 40 has its outer perimeter connected to a housing 50 which can be mounted to a backside of a frame piece 52.

Figure 5:
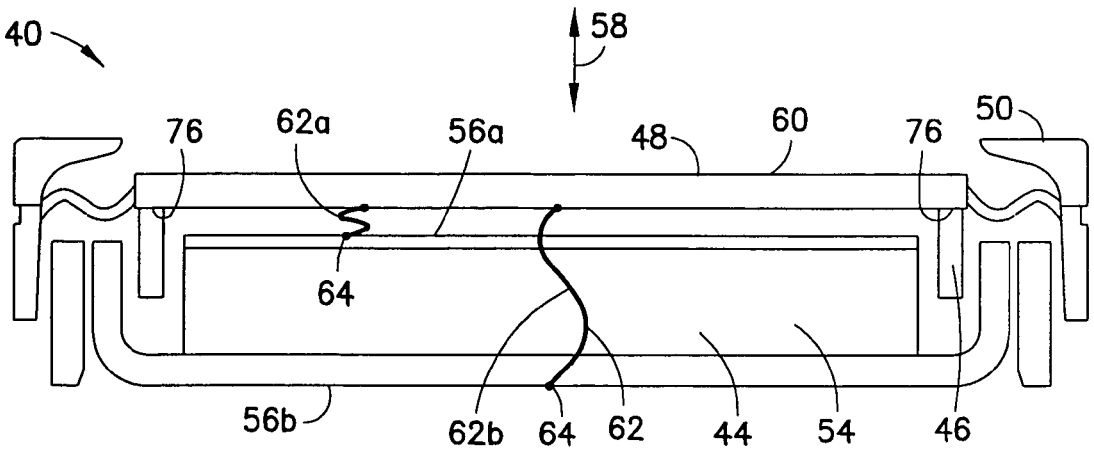
FIG. 5 is a schematic cross section view of the speaker shown in FIG. 4.
Figure 6:
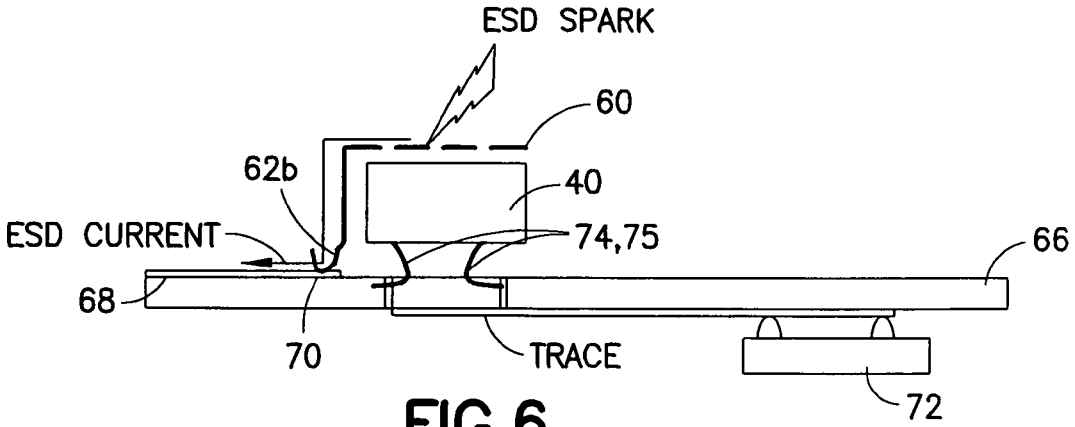
FIG. 6 is a schematic view illustrating connection of the speaker to a printed wiring board.

Referring also to FIGS. 5-6, the speaker 40 includes a magnet system 44, a coil 46, and the diaphragm 48 connected to the coil 44. The magnet system 44 comprises at least one permanent magnet 54 and pole pieces 56*a*, 56*b*. In an alternate embodiment the magnet could be an electromagnet. More than two pole pieces could be provided. Some examples of magnet and pole piece arrangements are described and shown in U.S. patent publication No. 2013/0278364 A1 which is hereby incorporated by reference in its entirety.

In the example shown in FIGS. 4-6 the coil 46 is energized to move the coil 46 and the diaphragm 48 relative to the magnet system 44 as indicated by arrow 58. In the example shown the diaphragm 48 comprises an membrane 60. The membrane 60 comprises an electrically conductive material. The metal membrane 60 may comprises aluminum for example. As the membrane 60 is moved as indicated by arrow 58, sound is produced from the speaker 40. The membrane 60 includes at least one electrical connector 62. The electrical connector or contact 62 may be a ground pin for example. The electrical connector 62 in this example comprises two electrical connectors 62*a*, 62*b*. In an alternate example embodiment more or less than two connectors may be provided. For example, in one example embodiment only the electrical connector 62*a* may be provided. As another example embodiment, only the electrical connector 62*b* may be provided. In one type of example embodiment the contacts 62 are integrally formed with the metal membrane 60. However, in an alternate example the connector/contact 62 for the metal membrane 60 may not be integrally formed with the metal membrane. The electrical connector(s) could be a separate member from the metal membrane. Each of the electrical connectors 62*a*, 62*b* comprise an electrical connection area 64 to connect the metal membrane 60 to ground. As used herein, an indication that a connector(s) is configured to connect the membrane to ground is intended to include where a galvanic connection is provided of the connector to the ground or where a small gap is provided between the connector and the ground (as further described below).

The first electrical connector 62*a* is a resiliently deflectable cantilevered arm having its electrical connection area 64 at the distal end of the arm. The electrical connection area 64 of the first electrical connector 62*a* is located against the top surface of the pole piece 56*a*. The pole piece 56*b* is mounted on the printed wiring board (PWB) 66 and is electrically connected to a ground layer 68 of the PWB 66. Thus, the metal membrane 60 is electrically connected to the ground layer 68 by the two pole pieces 56*a*, 56*b* through the electrically conductive magnet 54.

The second electrical connector 62*b* is a resiliently deflectable cantilevered arm having its electrical connection area 64 at the distal end of the arm. The electrical connection area 64 of the second electrical connector 62*b* is located against the top surface of the PWB 66; against a contact pad 70 of the ground layer 68. Thus, the metal membrane 60 is electrically connected to the ground layer 68 by the connector 62*b*. One or both of the connectors 62 may comprise, for example, a spring terminal, a leaf terminal, or a non-resilient terminal, such as connection pads suitably designed as part of the transducer chassis.

Features as described herein may be used with speakers, earpieces, transducer integration to mechanics, acoustics, and ESD protection. Features may apply to any type of speaker or earpiece in mobile devices, such as mobile phones, tablets, navigation devices, PDAs and laptops.

A spark from an electrostatic discharge (ESD) can easily upset or break a modern integrated handsfree (IHF) speaker amplifier 72 when the ESD conducts into the sound outlet and to the speaker. Modern speaker amplifiers are very vulnerable to ESD due to limitations in silicon area, cost, and increased digital signal processing (DSP) on chip (audio DSP algorithms, speaker protection, etc).

One type of fix for the problem may comprise adding passive components (ferrites, varistors) in speaker lines to protect the amplifier 72. However, these passive components are costly, they require PWB footprint, cause extra logistics effort, slow down production and add complexity. Also, the audio performance will be lower than with a simple circuit with less losses and resistance.

Another way to protect the speaker from an ESD spark is to add a metal plate in front of the speaker that presents low impedance to ground for the ESD spark, so that the ESD spark can be guided to ground. This can be achieved by either directly grounding the metal plate to the system ground or very narrow spark gap to the ground. However, adding a separate metal plate is rarely possible in product design due to added Z height and design complexity. The extra plate needs to be acoustically sealed to the component by adhesive or a poron layer which add more Z height, and adds design and assembly complexity. Such kind of structure is also challenging for design and assembly task and, in many products, not even possible. Adding a separate metal plate and acoustically sealing it with adhesive/poron layer might be provided without grounding the plate, but the plate would be floating (not grounded), and it is not possible to get low impedance to ground so that an ESD spark can be easily guided to ground. A floating plate in that way has a high ESD risk. Grounding the plate requires extra design effort from product mechanics and is not possible in many designs. Some conventional mobile phones use a speaker with a metal (e.g., aluminum) membrane to get better bass effect. However, the metal membrane is not connected to ground and, therefore, does not provide ESD shielding as noted in the floating plate construction described above.

Features as described herein may be used to solve the ESD shielding problem with use of a metal speaker membrane as an ESD shield by connecting the metal membrane to ground. Thus, the ESD shield does not need to be provide as a separate part. Instead, a single member (such as membrane 60) can be used to accomplish two functions, namely, speaker diaphragm and ESD shielding. The result is a re-designed speaker with an integrated ESD protection. Grounding the front metal plate to the PWB may be provided by designing a third contact leg from the speaker to the PWB (where the coil has the two other contact legs/leads 74, 75 shown in FIGS. 7-8). By merely connecting the metal plate 60 to ground, this will take care of the ESD problem. Features as described herein may provide a ready solution (fully integrated speaker component) that includes the grounded metal plate for ESD protection.

Using the metal membrane as both a speaker diaphragm and as an ESD shield reduces the total solution Z thickness because no separate adhesive/poron layer is needed between the speaker component and shield plate. In logistics and mechanical integration, it is more convenient to have the whole package integrated as one unit compared to building the solution from pieces and designing separate wiring for grounding the metal plate onto the PWB.

Features as described herein may be used to provide a novel speaker module design solution with effective integrated ESD protection that can reuse the existing structure (e.g., metal membrane) as much as possible. ESD is firstly attracted by the metal membrane and then guided to system ground 68 in the PWB through the low impedance path between the membrane 60 and system ground. The low impedance path can be achieved by either the direct Galvanic connection or a small air gap (e.g., <0.5 mm) between the membrane and the GND. Thus, the connector(s) may be configured to indirectly connect the membrane to ground through a small air gap; not necessarily a direct connection to the ground. In one example simulation, without features as described herein, the driver 72 can be damaged by a 12 kV air discharge. However, with features as described herein spark routing protocol (SPR) at 15 kV can be passed.

With features as described herein, effective ESD protection may be provided. It can effectively trap the ESD sparks from all the directions to the speaker and guide them to ground, providing effective protection for both positive and negative terminals of the driver 72. There is no penalty in z-direction thickness as there is no need for an additional metal layer below or above the module. There is minimal cost increase as there is no need for an additional metal film. Regarding the impact on acoustic performance, this can be minimal. The grounding contact(s) 62 on the membrane 60 may be located at where the membrane 60 is fixed to the housing 50, therefore, it will not impact the vibration of the diaphragm. ESD protection also works without direct galvanic contact, if the air gap between the membrane and the grounding is small enough (such as less than 0.5 mm for example).

The metal membrane 60 may be connected/wired to a separate ground pin internally (now shown). However, a dedicated ground pin(s) is not required because the membrane can connect to the pole piece/magnet (below which is electrically conductive), and/or can be connected to ground by an external spring/leaf/conducting gasket on the PWB (or flexible printed circuit FPC).

There are some other types of speakers without metal membrane. In these cases, the speaker may have a floating metal cover over the top edge of the speaker, but which is not connected to ground. Similar as the embodiment of grounding of the metal membrane, grounding of the metal cover inside the speaker module can also distinctively improve the ESD performance.

Electrically connecting the metal membrane to the ground on PWB/FPC is convenient with the leg contact 62. Modern THF amplifiers' ESD vulnerability problem is solved by a grounded plate as the membrane of the speaker. Features include ease of design and assembly, easier logistics and smaller product design, manufacturing and care cost.

Figure 7:
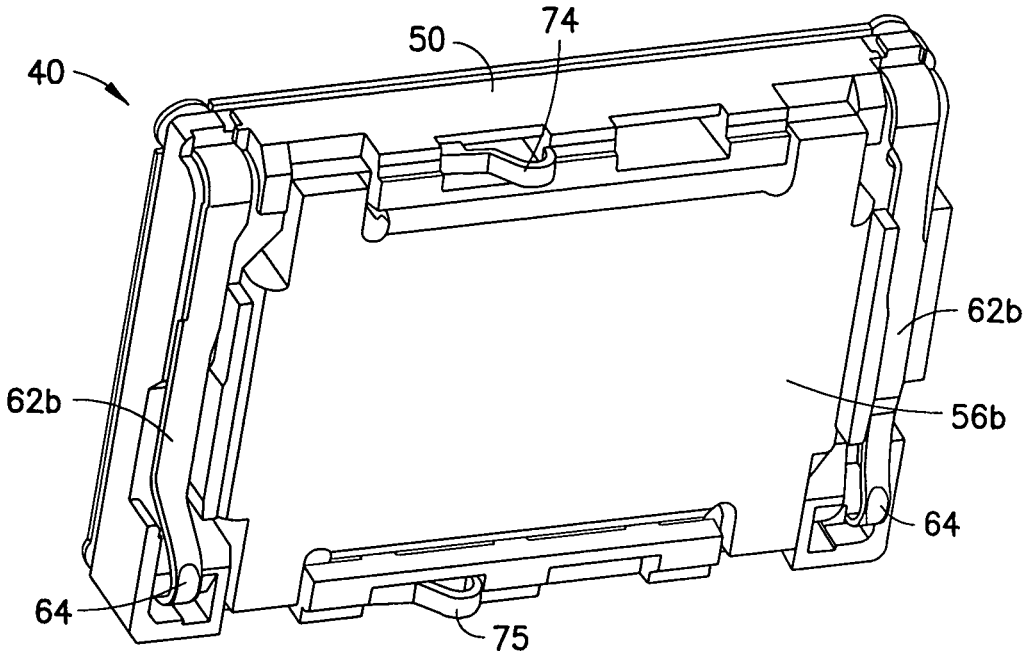
FIG. 7 is a perspective view of the speaker shown in FIG. 4.
Figure 8:
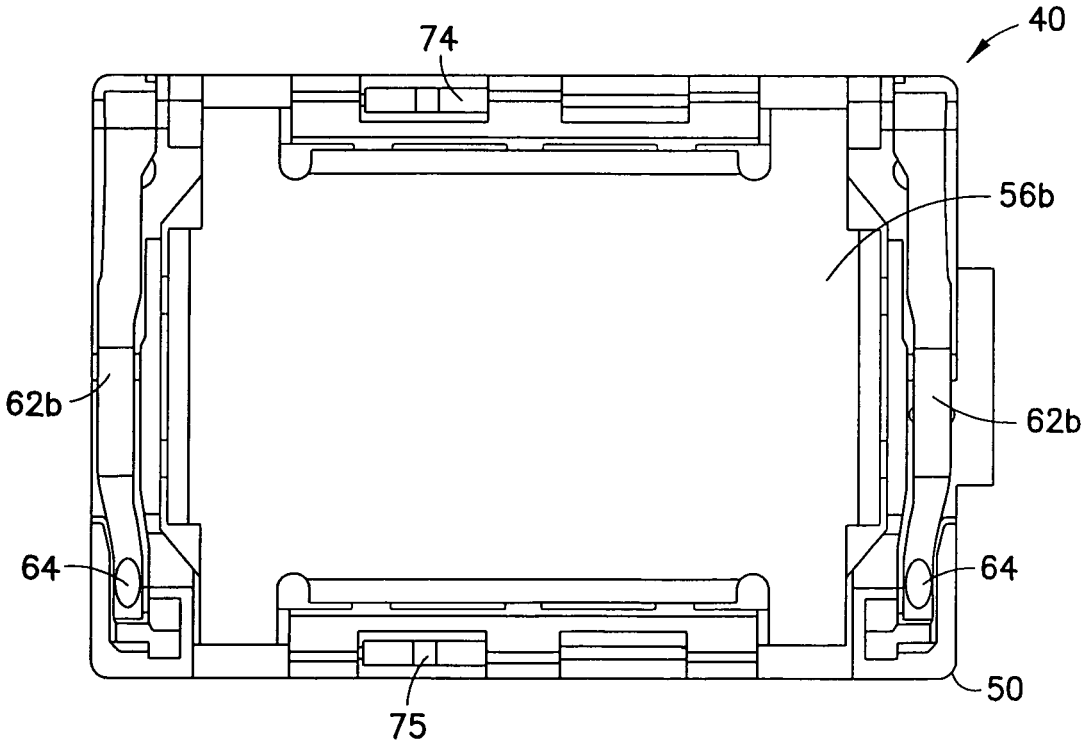
FIG. 8 is a bottom plan view of the speaker shown in FIG. 7.

Referring also to FIGS. 7 and 8, bottom views an example embodiment of the speaker 40 is shown. 74, 75 are electrical leads for the coil 46. Two of the electrical connectors 62*b* are provided. The connectors 62*b* each have a general cantilevered shape which is surface mounted to the PWB 66. The connectors 62*b* are electrically connected to the diaphragm at the perimeter edge of the diaphragm; where the diaphragm is connected to the housing 50. Therefore, the connectors 62*b* will not impact the vibration of the diaphragm. In one type of alternate example embodiment the diaphragm may comprise an assembly of components such as a resilient polymer membrane with a sprayed-on or attached electrically conductive member with a connector or contact to connect the metal member to ground. For the example embodiment shown in FIGS. 7-8, the speaker 40 has both the electrical leads 74, 75 to drive the coil 46, and at least one additional terminal (in this example terminals 62*b*) which all connect to a printed wiring board 66 when the speaker 40 is mounted to the PWB 66. Thus, the speaker 40 has at least one additional contact terminal for the speaker module in addition to the electrical terminals 74, 75 for driving the speaker.

Figure 9:
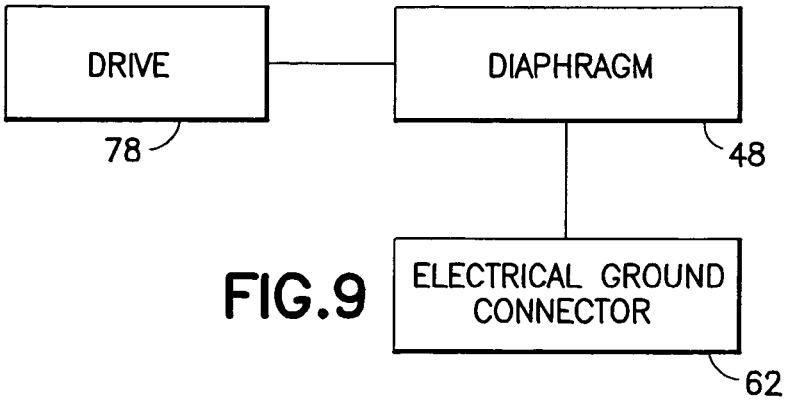
FIG. 9 is a diagram illustrating components of an example embodiment.

Referring also to FIG. 9, an example embodiment may comprise the diaphragm 48, a drive 78 and the electrical connector/contact 62. The drive 78 may comprise the coil 46 and permanent magnet(s) 44 described above. In an alternate example embodiment the drive may comprise, for example, a piezoelectric drive or an electrostatic drive, such as for a piezoelectric speaker or a electrostatic speaker. Any suitable drive could be used.

An example embodiment may be provided in an apparatus comprising a magnet system; at least one pole piece connected to the magnet system; a coil; and a diaphragm connected to the coil, where the diaphragm comprises a metal membrane having a connector for electrically connecting the metal membrane to ground.

The apparatus may further comprise electrical insulation 76 between the metal membrane and the coil. The connector may comprise a resilient electrical contact arm which is configured to resiliently deflect. The resilient electrical contact arm may comprise a surface mount contact area adapted to make a surface contact with another member. The resilient electrical contact arm may make the surface contact with a contact pad on a printed wiring board. The resilient electrical contact arm may make the surface contact with a first one of the at least one pole piece. The connector may be electrically connected in series to a first one of the at least one pole piece, at least one magnet of the magnet system, and a second one of the at least one pole piece. The apparatus may comprise means for electrostatic discharge shielding comprising the metal membrane of the diaphragm. The apparatus may further comprise a printed wiring board having a ground, where the metal membrane is connected to the ground by the connector; an electrical display connected to the printed wiring board; a receiver connected to the printed wiring board; a transmitter connected to the printed wiring board; a processor connected to the printed wiring board; a memory connected to the printed wiring board; and a battery connected to the printed wiring board.

An example method may comprise providing a speaker diaphragm comprising a metal membrane, where the metal membrane comprises an electrical connection area adapted to connect the metal membrane to ground; and connecting the diaphragm to a coil.

The method may further comprise electrically insulating the metal membrane from the coil. The metal membrane may comprise a resiliently deflectable arm having the electrical connection area thereon. A majority of the metal membrane may be stationarily connected to the coil to move with the coil. The method may further comprise electrically connecting the electrical connection area of the metal membrane on an electrical contact pad of a printed wiring board. The method may further comprise electrically connecting the electrical connection area of the metal membrane on to a pole piece connected to a magnet.

An example method may comprise providing a speaker comprising a diaphragm which includes a metal membrane, where the metal membrane comprises an electrical connection section; and connecting the speaker to a printed wiring board, where, when the speaker is connected to the printed wiring board, the metal membrane is electrically connected through the electrical connection section to the printed wiring board.

The electrical connection section of the metal membrane may be provided as a resiliently deflectable arm having the electrical connection area thereon. The electrical connection area may contact a contact pad on the printed wiring board. The electrical connection area may contact a pole piece of the speaker, where the metal membrane is electrically connected to the printed wiring board through the pole piece. Connecting the speaker to the printed wiring board may comprise resiliently deflecting the electrical connection section of the metal membrane.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

a diaphragm comprises a membrane;

a drive configured to move the diaphragm when an audio signal is received; and an electrostatic discharge shield, where the electrostatic discharge shield comprises the membrane comprising electrically conductive material and a connector configured to connect the membrane to a ground in use, where the apparatus comprises an audio transducer formed by the diaphragm and the drive.

2. An apparatus as in claim 1 where the drive comprises a magnet system, at least one pole piece connected to the magnet system, and a coil, where electrical insulation is provided between the membrane and the coil.

3. An apparatus comprising:

a diaphragm comprises a membrane comprising electrically conductive material;

a drive configured to move the diaphragm when an audio signal is received; and a connector configured to connect the membrane to ground in use, where the apparatus comprises an audio transducer formed by the diaphragm and the drive, where the connector comprises a resilient electrical contact which is configured to resiliently deflect.

4. An apparatus as in claim 3 where the resilient electrical contact comprises a surface mount contact area adapted to make a surface contact with another member.

5. An apparatus as in claim 4 where the resilient electrical contact makes the surface contact with a contact pad on a printed wiring board.

6. An apparatus as in claim 4 where the resilient electrical contact makes the surface contact with a first one pole piece of the drive.

7. An apparatus as in claim 1 where the connector is electrically connected in series to a first pole piece of the drive, at least one magnet of a magnet system of the drive, and a second pole piece of the drive.

8. An apparatus as in claim 1 where the apparatus comprises means for electrostatic discharge shielding comprising the membrane of the diaphragm.

9. An apparatus as in claim 1 further comprising:

a printed wiring board having a ground, where the membrane is connected to the ground by the connector;

an electrical display connected to the printed wiring board;

a receiver connected to the printed wiring board;

a transmitter connected to the printed wiring board;

a processor connected to the printed wiring board;

a memory connected to the printed wiring board; and a battery connected to the printed wiring board.

10. An apparatus as in claim 1 where the apparatus is a speaker module comprising at least three electrical leads, where the at least three electrical leads comprise:

at least two leads with the drive, and at least one separate lead with the membrane, where the at least one separate lead is provided by the connector.

11. An apparatus as in claim 1 where the connector is configured to provide a gap between the connector and a ground contact area on a printed wiring board when the apparatus is connected to the printed wiring board, where the connector is not galvanically connected to the printed wiring board.

12. A method comprising:

providing a speaker diaphragm, where the speaker diaphragm comprises a membrane, where the membrane comprises electrically conductive material along a majority of the speaker diaphragm, where the membrane comprises a connector configured to connect the membrane to a ground, where the electrically conductive material and the connector form an electrostatic discharge shield; and connecting the diaphragm to a drive, where the drive is configured to move the diaphragm.

13. A method as in claim 12 where the drive comprises a coil, and where the method further comprises electrically insulating the membrane from the coil.

14. A method as in claim 12 the membrane comprises a resiliently deflectable contact forming the connector.

15. A method as in claim 12 where the drive comprises a coil, and where a majority of the membrane is stationarily connected to the coil to move with the coil.

16. A method as in claim 12 further comprising electrically connecting the connector onto an electrical contact pad of a printed wiring board.

17. A method as in claim 12 further comprising electrically connecting the connector onto a pole piece connected to a magnet.

18. A method comprising:

providing a speaker comprising a diaphragm which includes a membrane, where the membrane comprises electrically conductive material along a majority of the diaphragm, where the membrane comprises an electrical connection section, where the electrically conductive material and the electrical connection section form an electrostatic discharge shield; and connecting the speaker to a printed wiring board, where, when the speaker is connected to the printed wiring board, the membrane is electrically connected through the electrical connection section to the printed wiring board.

19. A method as in claim 18 where the electrical connection section of the membrane is provided as a resiliently deflectable contact having the electrical connection area thereon, where the electrical connection area contacts a contact pad on the printed wiring board.

20. A method as in claim 18 where the electrical connection section of the membrane is provided as a resiliently deflectable contact having the electrical connection area thereon, where the electrical connection area contacts a pole piece of the speaker, where the membrane is electrically connected to the printed wiring board through the pole piece.

21. A method as in claim 18 where the electrical connection section of the membrane is electrically connected to the printed wiring board through at least one of a pole piece of the speaker and a magnet of the speaker.

22. An apparatus as in claim 1 where the electrically conductive material is located along a majority of the diaphragm.

23. An apparatus as in claim 1 where the connector is electrically connected to at least one of a pole piece of the drive and a magnet system of the drive.

* * * * *